US011424574B1

(12) United States Patent
Huang et al.

(10) Patent No.: US 11,424,574 B1
(45) Date of Patent: Aug. 23, 2022

(54) TERMINAL ELECTRICAL CONNECTOR AND ELECTRICAL CONNECTOR ASSEMBLY COMPRISING THEREOF

(71) Applicant: KUNSHAN OUTDOOR SOLUTIONS ELECTRONICS CO., LTD., Kunshan (CN)

(72) Inventors: De Yao Huang, Kunshan (CN); Teng Sheng Hung, Kunshan (CN); Jui Chih Hung, Kunshan (CN); Feng Ching Hsueh, Kunshan (CN)

(73) Assignee: KUNSHAN OUTDOOR SOLUTIONS ELECTRONICS CO., LTD., Kunshan (CN)

( * ) Notice: Subject to any disclaimer, the term of this patent is extended or adjusted under 35 U.S.C. 154(b) by 0 days.

(21) Appl. No.: 17/209,671

(22) Filed: Mar. 23, 2021

(51) Int. Cl.
*H01R 13/625* (2006.01)
*H01R 13/631* (2006.01)

(52) U.S. Cl.
CPC ..... *H01R 13/625* (2013.01); *H01R 13/631* (2013.01)

(58) Field of Classification Search
CPC ..... H01R 13/625; H01R 13/631
See application file for complete search history.

(56) References Cited

U.S. PATENT DOCUMENTS 4,365,858 A * 12/1982 Karol ..... H01R 13/447 439/135
7,011,544 B1 * 3/2006 Zemba ..... H01R 13/625 439/578
2005/0176293 A1 * 8/2005 Khemakhem ..... H01R 24/40 439/578
2006/0046566 A1 * 3/2006 Zemba ..... H01R 13/625 439/578
2014/0295690 A1 * 10/2014 Quero pacheco .... H01R 13/521 439/271
2018/0083373 A1 * 3/2018 Hung ..... H01R 4/2412

* cited by examiner

*Primary Examiner* — Abdullah A Riyami
*Assistant Examiner* — Nader J Alhawamdeh
(74) *Attorney, Agent, or Firm* — Muncy, Geissler, Olds & Lowe, P.C.

(57) ABSTRACT

The present invention provides a terminal electrical connector, which includes a terminal unit and a rotating cap. The terminal unit includes a terminal unit body, one or a plurality of electrical terminals provided inside the terminal unit body, and a torsion spring positioned on the terminal unit body. A limiting groove for limiting a pivotal stroke and a first positioning groove for positioning a first end of the torsion spring are provided on an outer peripheral side of the terminal unit body. The rotating cap includes a cap body, and one or a plurality of locking blocks provided on the cap body for locking on another terminal electrical connector. A sliding block and a second positioning groove are provided on an inner circumference of the cap body. The sliding block is used for limiting the pivotal stroke of the rotating cap relative to the terminal unit body, and the torsion spring is used for inertially returning the rotating cap to a position of a reset angle relative to the terminal unit body.

9 Claims, 14 Drawing Sheets

TERMINAL ELECTRICAL CONNECTOR AND ELECTRICAL CONNECTOR ASSEMBLY COMPRISING THEREOF

BACKGROUND OF THE INVENTION

1. Technical Field

The present invention relates to a terminal electrical connector and an electrical connector assembly comprising thereof, and more particularly to a quick-disassembly and quick-assembly terminal electrical connector and an electrical connector assembly comprising thereof.

2. Description of Related Art

An electrical connector is a conductive device that connects electrical circuits. These components can be used as end points for connections between different components in the same circuit system, or used to provide power and data connections between different circuit systems and devices. Electrical connectors are widely used in various electrical circuits to provide the function of connecting or disconnecting circuits. The electrical connector is called a pair of male and female because of its form. In the common form, the mobile end is mostly male and the fixed end is mostly female. Sometimes it is determined by the appearance of the electrical connector.

In addition to meeting general performance requirements, electrical connectors must achieve good electrical contact, high reliability, and high convenience according to actual needs. Since product reliability may affect the operation of the overall equipment, the requirements for reliability of electrical connectors are of course high. Therefore, equipment manufacturers have very strict requirements on the quality and reliability of electrical connectors. Depending on usage and function, electrical connectors may include different shapes, structures, etc.

BRIEF SUMMARY OF THE INVENTION

The primary objective of the present invention is to provide a terminal electrical connector, which includes a terminal unit and a rotating cap. The terminal unit includes a terminal unit body, one or a plurality of electrical terminals provided inside the terminal unit body, and a torsion spring positioned on the terminal unit body. A limiting groove for limiting a pivotal stroke and a first positioning groove for positioning a first end of the torsion spring are provided on an outer peripheral side of the terminal unit body. The rotating cap includes a cap body, and one or a plurality of locking blocks provided on the cap body for locking on another terminal electrical connector. A sliding block and a second positioning groove are provided on an inner circumference of the cap body. The sliding block is correspondingly provided in the limiting groove to limit the pivotal stroke of the rotating cap relative to the terminal unit body. The torsion spring has a second end provided inside the second positioning groove so that the rotating cap is inertially returned to a position of a reset angle relative to the terminal unit body.

Another objective of the present invention is to provide an electrical connector assembly including the above-mentioned terminal electrical connector and an another terminal electrical connector. The another terminal electrical connector is electrically connected to the terminal electrical connector. The another terminal electrical connector includes an another terminal unit body and one or a plurality of electrical terminals provided inside the another terminal unit body. The another terminal unit body has an outer peripheral surface provided with locking grooves corresponding to the number and positions of the locking blocks. The another terminal unit body of the another terminal electrical connector is butted with the terminal unit body of the terminal electrical connector to form an electrical connection. The locking block on the rotating cap is inserted into and locked to the locking groove via an inertial force of the torsion spring to limit an axial stroke between the terminal electrical connector and the another terminal electrical connector.

Therefore, the terminal electrical connector of the present invention can not only achieve the effect of quick disassembly and quick assembly, but also achieve relatively high strength in the connection in the plugging axis, and has high convenience and reliability. In addition, in terms of secondary effects, the terminal electrical connector of the invention is easier to assemble than the conventional electrical connector in the assembling process, thereby effectively improving the efficiency of the manufacturing process and reducing the cost.

DETAILED DESCRIPTION OF THE INVENTION

Figure 1:
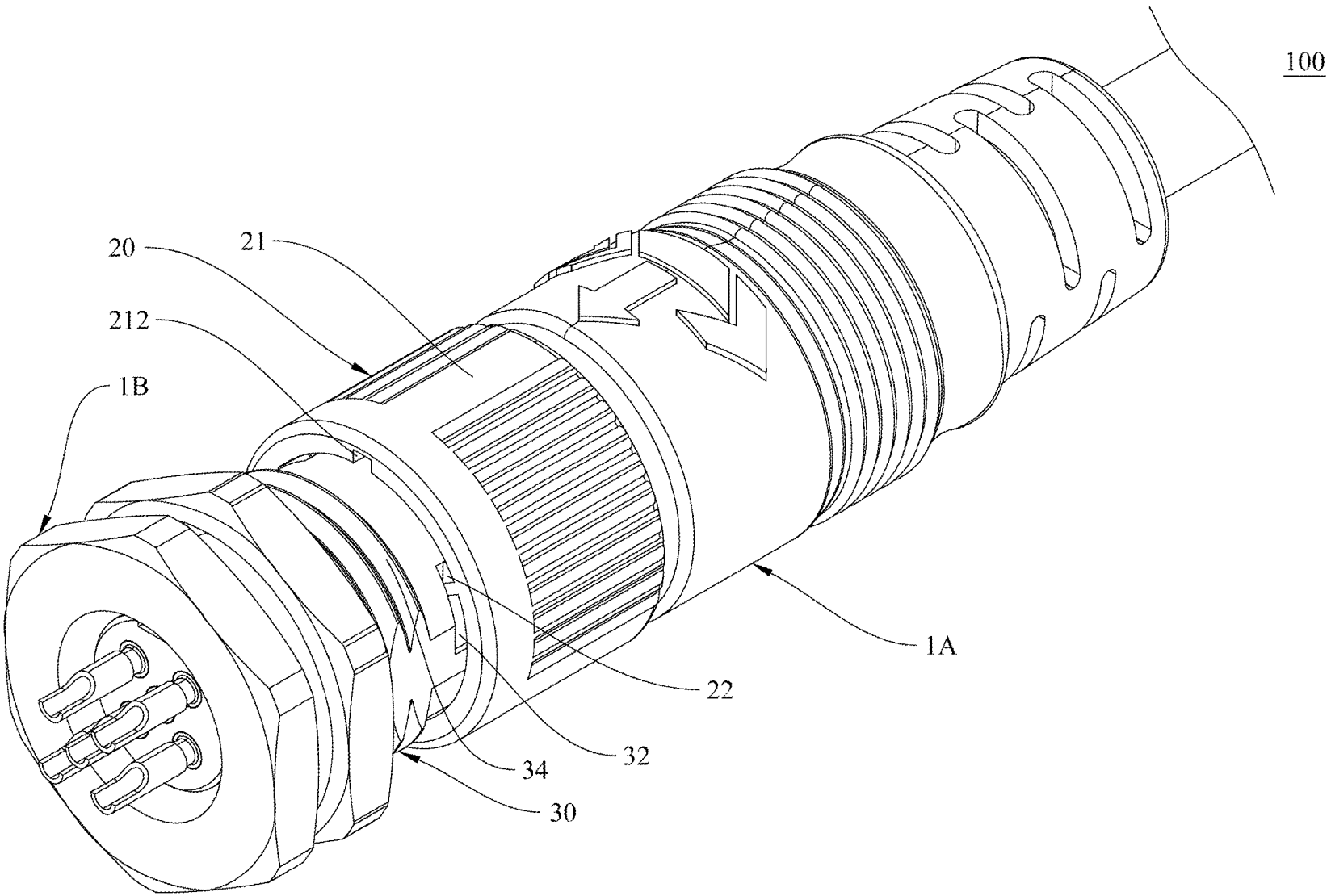
FIG. 1 is a perspective view of the first embodiment of the present invention.

The details and technical solution of the present invention are hereunder described with reference to accompanying drawings. For illustrative sake, the accompanying drawings are not drawn to scale. The accompanying drawings and the scale thereof are not restrictive of the present invention.

The following describes the first embodiment of the present invention. Please refer to FIG. 1 to FIG. 4 respectively for a perspective view, an exploded schematic diagram (1) of the structure, an exploded schematic diagram (2) of the structure, and a partially transparent schematic diagram of the first embodiment of the present invention.

This embodiment discloses an electrical connector assembly 100, which includes a first terminal electrical connector 1A and a second terminal electrical connector 1B that are arranged corresponding to each other. The combination of the first terminal electrical connector 1A and the second terminal electrical connector 1B constitutes an electrical connection.

The first terminal electrical connector 1A mainly includes a first terminal unit 10 and a rotating cap 20 provided on the first terminal unit 10. The first terminal unit 10 includes a first terminal unit body 11, one or a plurality of electrical terminals 12 provided inside the first terminal unit body 11, and a torsion spring 13 positioned on the first terminal unit body 11. The outer peripheral side of the first terminal unit body 11 is provided with a limiting groove 14 for limiting the pivotal stroke and a first positioning groove 15 for positioning a first end 131 of the torsion spring 13. A convex seat 141 is provided on one side of the limiting groove 14. The rotating cap 20 includes a cap body 21 and one or a plurality of locking blocks 22 provided on the cap body 21 for locking on the second terminal electrical connector 1B. A sliding block 211 and a second positioning groove 212 are provided on the inner peripheral surface of the cap body 21. The sliding block 211 is correspondingly provided in the limiting groove 14 to limit the pivotal stroke of the rotating cap 20 relative to the first terminal unit body 11. A second end 132 of the torsion spring 13 is provided inside the second positioning groove 212 to inertially return the rotating cap 20 to the position of the reset angle relative to the first terminal unit body 11. In one embodiment, the locking block 22 is provided with a first guiding slope 221.

In one embodiment, the second positioning groove 212 includes a guiding groove 2121 extending to an opening on one side of the rotating cap 20 for the introduction of the second end 132 of the torsion spring 135 and a limiting groove 2122 provided at the inner end of the guiding groove 2121. Both sides of the limiting groove 2122 are provided with a limiting wall 2123. The design of the limiting wall 2123 prevents the second end 132 of the torsion spring 13 from leaving the limiting groove 2122.

In one embodiment, in order to strengthen the bonding strength of the rotating cap 20 and the first terminal unit 10 in the plugging axis, the inner peripheral surface of the rotating cap 20 is provided with one or a plurality of positioning wings 23, and the outer peripheral side of the first terminal unit 10 is provided with one or a plurality of lateral locking portions 16 provided in conjunction with the positioning wings 23. The lateral locking portion 16 includes a first thrust wall 161, a second thrust wall 162, and a fitting groove 163 provided between the first thrust wall 161 and the second thrust wall 162. The fitting groove 163 is configured to allow the positioning wing 23 to be inserted when the sliding block 211 is locked in the limiting groove 14 to limit the axial stroke of the rotating cap 20 relative to the first terminal unit 10. In one embodiment, in order to allow the positioning wing 23 to avoid the first thrust wall 161 when the rotating cap 20 and the first terminal unit 10 are combined in the axial direction, so that the positioning wing 23 is aligned to an opening OP between the first thrust wall 161 and the second thrust wall 162, the first thrust wall 161 is made shorter than the second thrust wall 162 to form a clearance space SP for the positioning wing 23 to enter the fitting groove 163.

The second terminal electrical connector 1B is configured to be electrically connected to the first terminal electrical connector 1A. The second terminal electrical connector 1B includes a second terminal unit body 30 and one or a plurality of electrical terminals 31 provided inside the second terminal unit body 30. The outer peripheral surface of the second terminal unit body 30 is provided with locking grooves 32 corresponding to the number and positions of the locking blocks 22 for the locking block 22 to be introduced and then locked and combined. The locking block 22 on the rotating cap 20 is inserted into and locked to the locking groove 32 via the inertial force of the torsion spring 13 to limit the axial stroke between the first terminal electrical connector 1A and the second terminal electrical connector 1B.

The second terminal unit body 30 of the second terminal electrical connector 1B is mated with the first terminal unit body 11 of the first terminal electrical connector 1A so that the terminal pins (electrical terminals 12) inside the first terminal unit body 11 are inserted into the terminal slots (electrical terminals 31) inside the second terminal unit body 30 to form an electrical connection.

Figure 7:
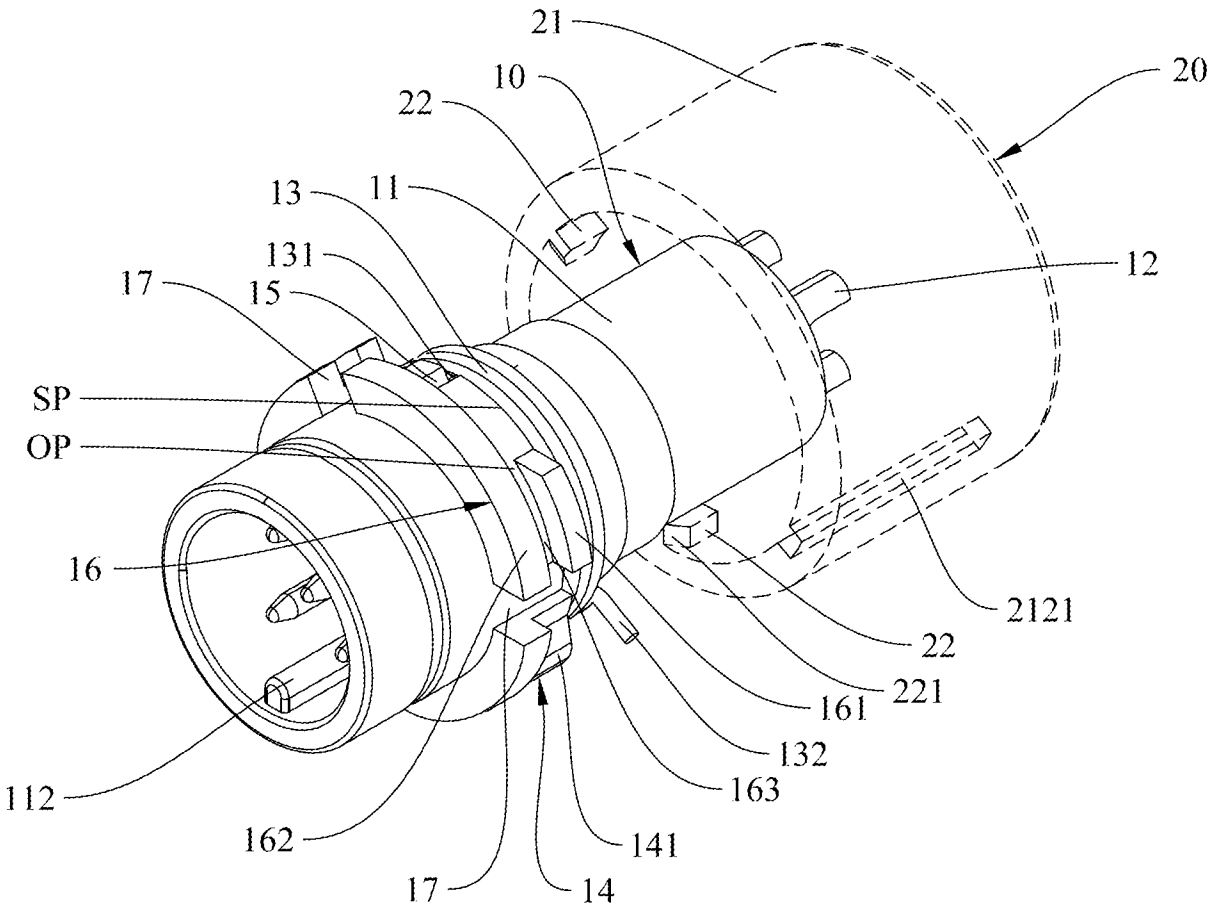
FIG. 7 is a schematic diagram (1) of the assembly process of the first embodiment of the present invention.

In an embodiment, the first terminal unit body 11 of the first terminal electrical connector 1A is provided with a first limiting portion 112 (as shown in FIG. 7), and the second terminal unit body 30 of the second terminal electrical connector 1B is provided with a second limiting portion 33 corresponding to the position of the first limiting portion 112. In this embodiment, the first limiting portion 112 is a fool-proof rib, and the second limiting portion 33 is a fool-proof groove. In another embodiment, the first limiting portion 112 is a fool-proof groove, and the second limiting portion 33 is a fool-proof rib. The first limiting portion 112 and the second limiting portion 33 can be implemented in any form to achieve the effect of interference positioning, and the present invention does not limit the change of the form of the first limiting portion 112 and the second limiting portion 33. In another embodiment, the first limiting portion 112 and the second limiting portion 33 can also be omitted according to actual conditions; the invention has no limitation in this regard.

In order to lock the locking block 22 on the rotating cap 20 in the locking groove 32 by the inertial force of the torsion spring 13 when the first terminal unit body 11 and the second terminal unit body 30 are combined to achieve the effect of anti-unlocking, the locking groove 32 includes an opening 321 provided on the outer peripheral surface and a groove 322 provided on the outer peripheral surface and communicating with the opening 321, and a second guiding slope 323 is provided on one side of the opening 321 of the locking groove 32, wherein the second guiding slope 323 is inclined from the outside to the inside toward the direction of the opening 321. The stroke between the opening 321 and the groove 322 corresponds to the range of the rotation stroke of the rotating cap 20 relative to the first terminal unit 10 (i.e., corresponds to the arc range of the limiting groove 14). Under the condition that the first limiting portion 112 is aligned with the second limiting portion 33, when the locking block 22 is aligned to the opening 321, the sliding block 211 is located in the limiting groove 14 at the tight first position corresponding to the torsion spring 13. Under the condition that the first limiting portion 112 is aligned with the second limiting portion 33, when the locking block 22 is aligned to the groove 322, the sliding block 211 is located in the limiting groove 14 at the release second position (relative to the first position) corresponding to the torsion spring 13. Through the aforementioned configuration, the inertial force of the torsion spring 13 provides a torsion force from the opening 321 toward the groove 322 to rotate the rotating cap 20 to lock the locking block 22 on the inner side of the groove 322.

In one embodiment, a screw thread 34 is provided on the outer peripheral surface of the second terminal unit body 30 to lock with an internal screw thread of a protective cover (not shown), which is not limited in the present invention.

The specific structure of the electrical connector assembly 100 of the present invention has been described in detail above. The following describes the use state of the electrical connector assembly 100 of the invention. Please refer to FIG. 5 and FIG. 6 respectively for a schematic diagram (1) of the combination of male and female terminals and a schematic diagram (2) of the combination of male and female terminals of the first embodiment of the invention.

Figure 2:
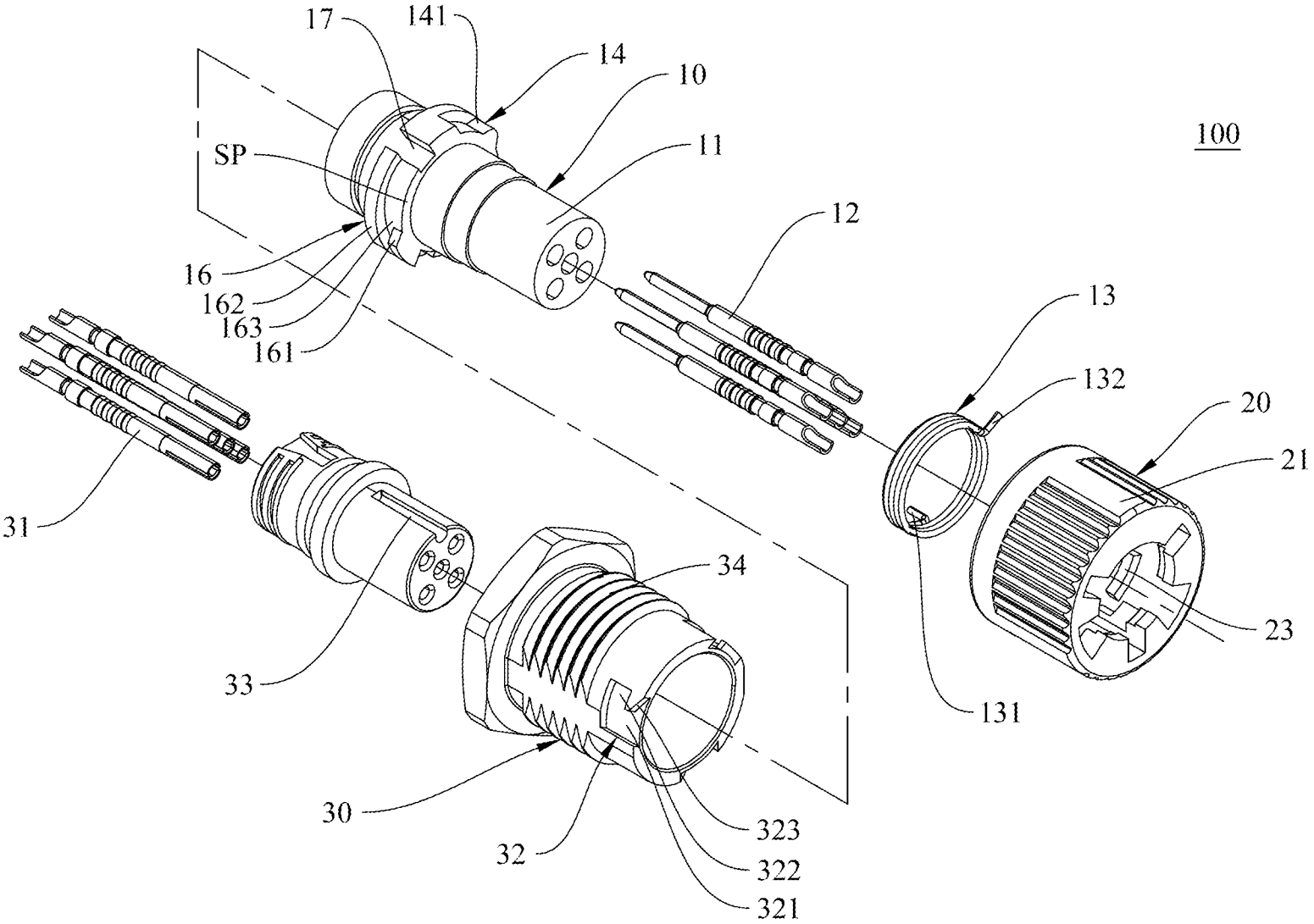
FIG. 2 is an exploded schematic diagram (1) of the structure of the first embodiment of the present invention.
Figure 3:
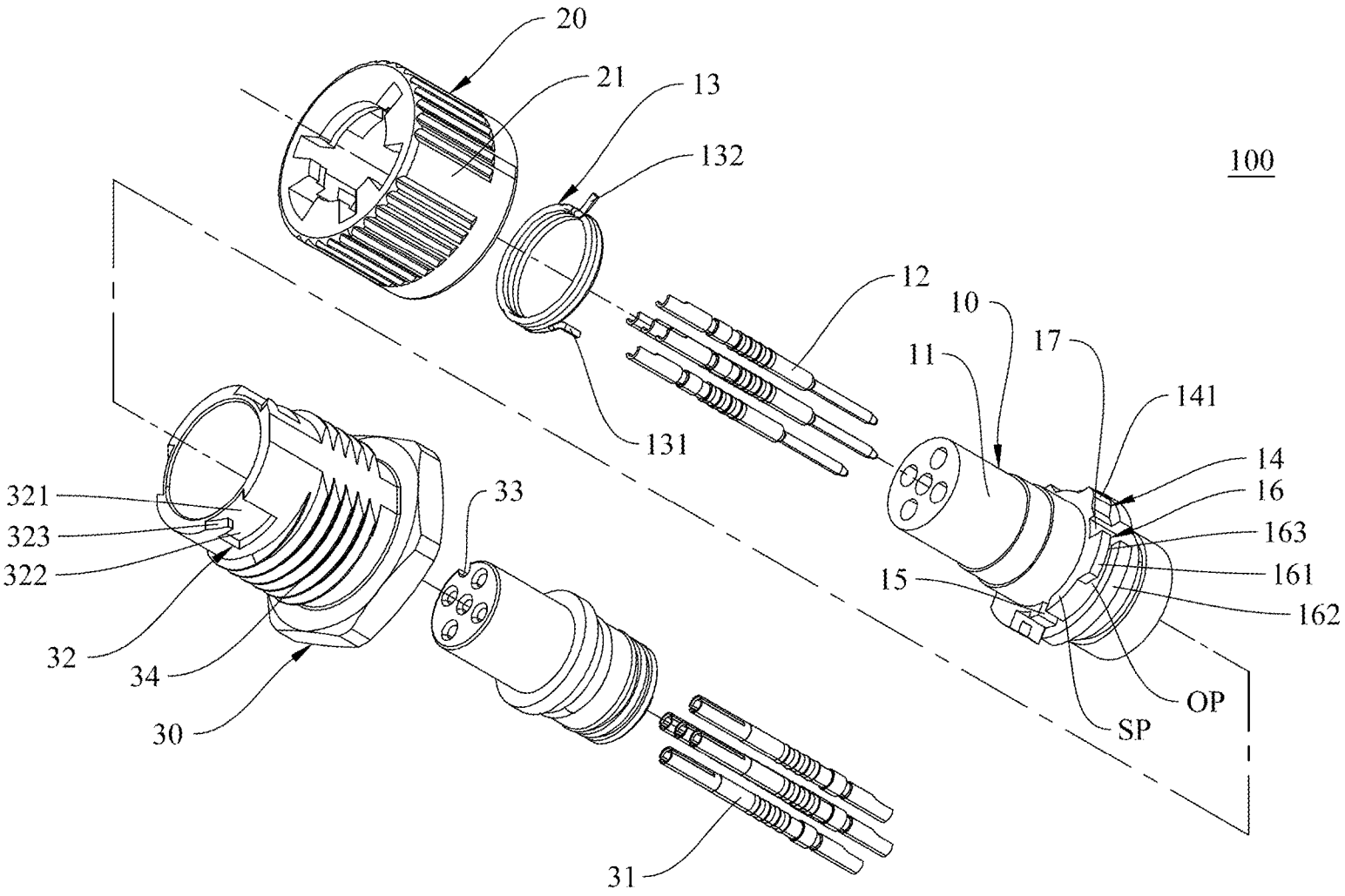
FIG. 3 is an exploded schematic diagram (2) of the structure of the first embodiment of the present invention.
Figure 4:
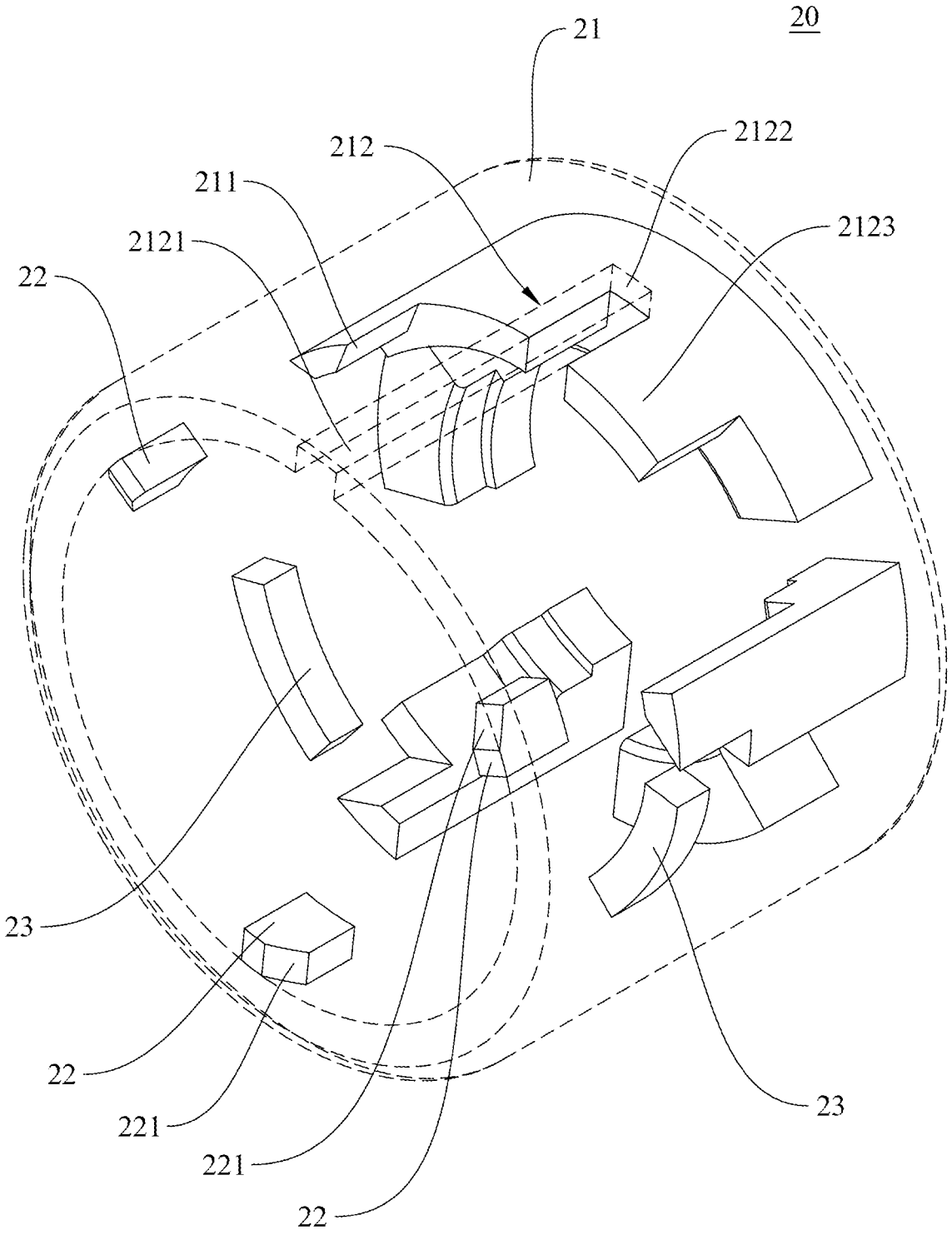
FIG. 4 is a partially transparent schematic diagram of the first embodiment of the present invention.
Figure 5:
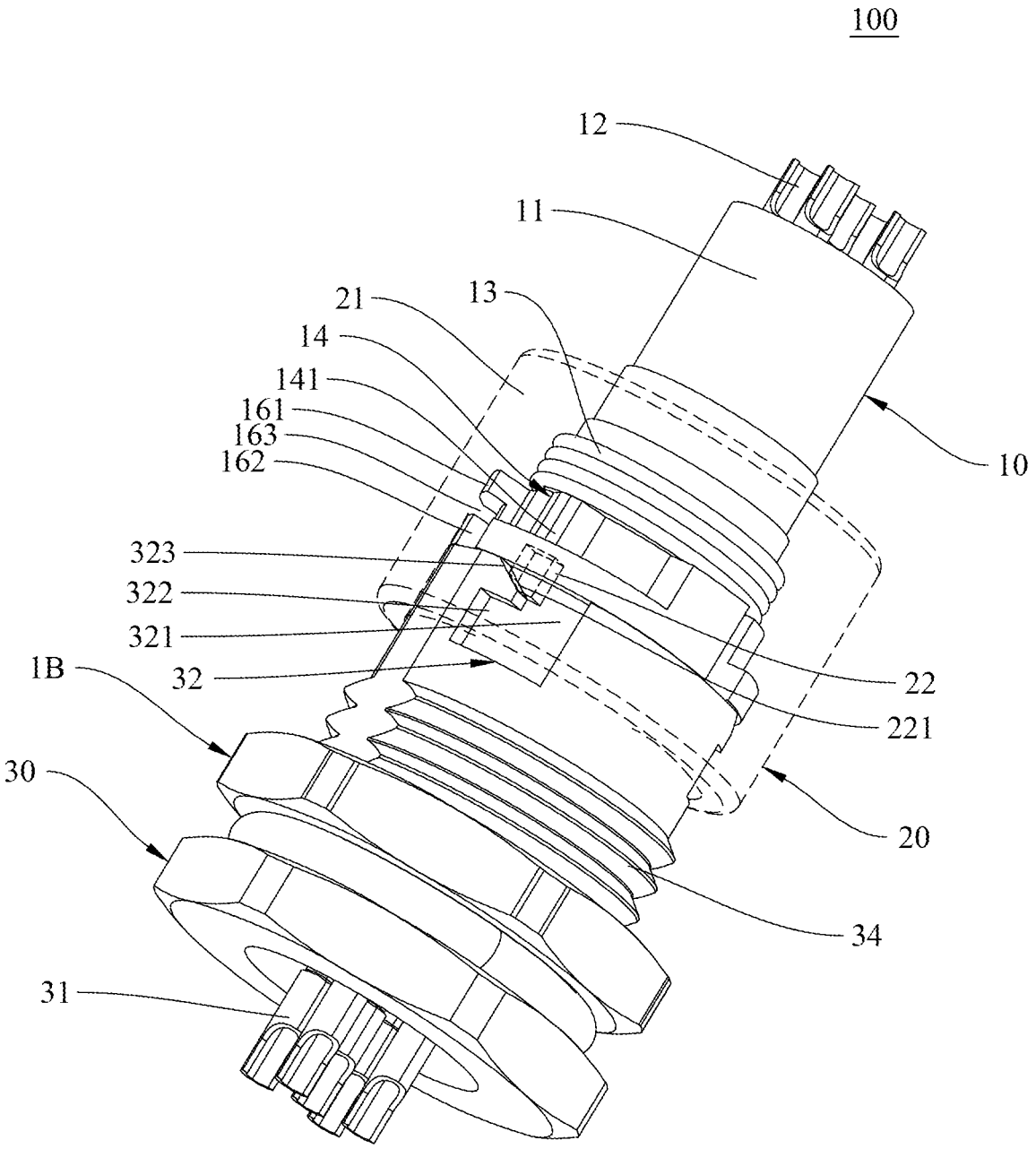
FIG. 5 is a schematic diagram (1) of the combination of male and female terminals in the first embodiment of the present invention.

First, as shown in FIG. 5, during the assembling stage of the male and female terminals, the first limiting portion 112 (e.g., a fool-proof rib) of the first terminal unit body 11 is aligned with the second limiting portion 33 (e.g., a fool-proof groove) of the second terminal unit body 30 (as shown in FIG. 2 and FIG. 7) to combine the first terminal unit body 11 and the second terminal unit body 30 in the axial direction. The rotating cap 20 is configured such that when the first limiting portion 112 is aligned to the second limiting portion 33, the first guiding slope 221 on the locking block 22 of the rotating cap 20 coincides with the second guiding slope 323 of the locking groove 32.

Figure 6:
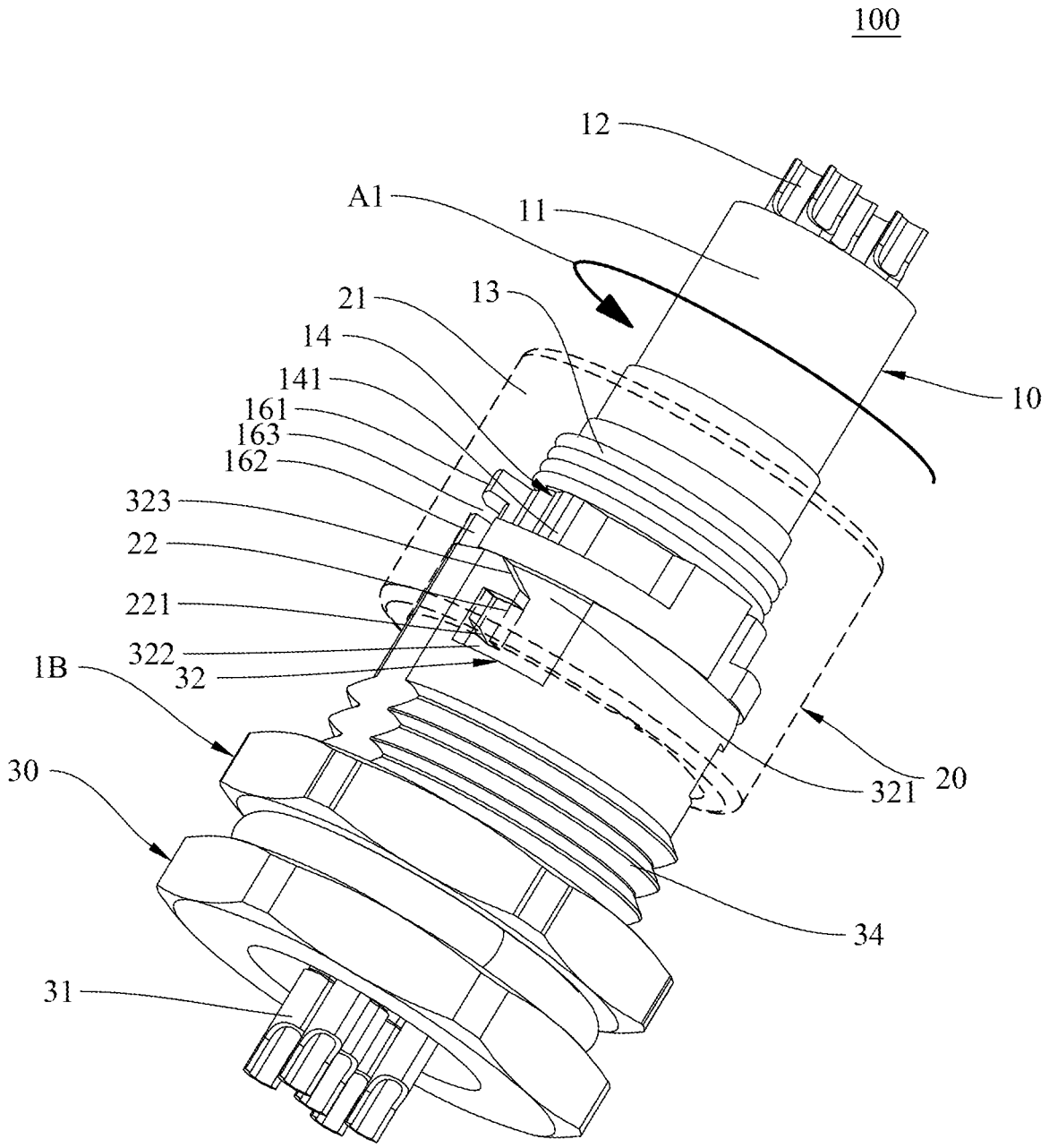
FIG. 6 is a schematic diagram (2) of the combination of male and female terminals in the first embodiment of the present invention.

Next, as shown in FIG. 6, when the first terminal unit body 11 is inserted into the second terminal unit body 30, the first guiding slope 221 on the locking block 22 of the rotating cap 20 is tightly pressed toward the second guiding slope 323 and moves toward the opening 321 as guided by the second guiding slope 323 (to tighten the torsion spring 13). After the locking block 22 enters the opening 321, the locking block 22 moves to the release side of the torsion spring 13, and receives the elastic force provided by the torsion spring 13 to move to the groove 322 via the position of the opening 321 (as shown by the arrow A1) to achieve a locking effect.

When removing the lock, it is only necessary to rotate the rotating cap 20 in the reverse direction (unlocking direction) to the very end and pull out the first terminal unit body 11 to achieve the unlocking effect. After being unlocked, the rotating cap 20 receives the elastic force of the torsion spring 13 and returns to the initial position.

For the assembly procedure of the first terminal electrical connector 1A, please refer to FIG. 7 to FIG. 12, which are schematic diagrams (1) to (6) of the assembly process of the first embodiment of the present invention.

In order to facilitate the description and clearly understand the technical features of the present invention, the rotating caps in the assembly process schematic diagrams of FIG. 7 to FIG. 12 respectively show only part of the internal structure, so as to clearly understand the assembly procedure of the invention.

Please refer to FIG. 7 first. In the assembly procedure, the central sleeve portion of the torsion spring 13 is sleeved on the outer peripheral side of the first terminal unit body 11, and the first end 131 of the torsion spring 13 is inserted into the positioning groove 15 to bond the torsion spring 13 to the first terminal unit body 11.

Figure 8:
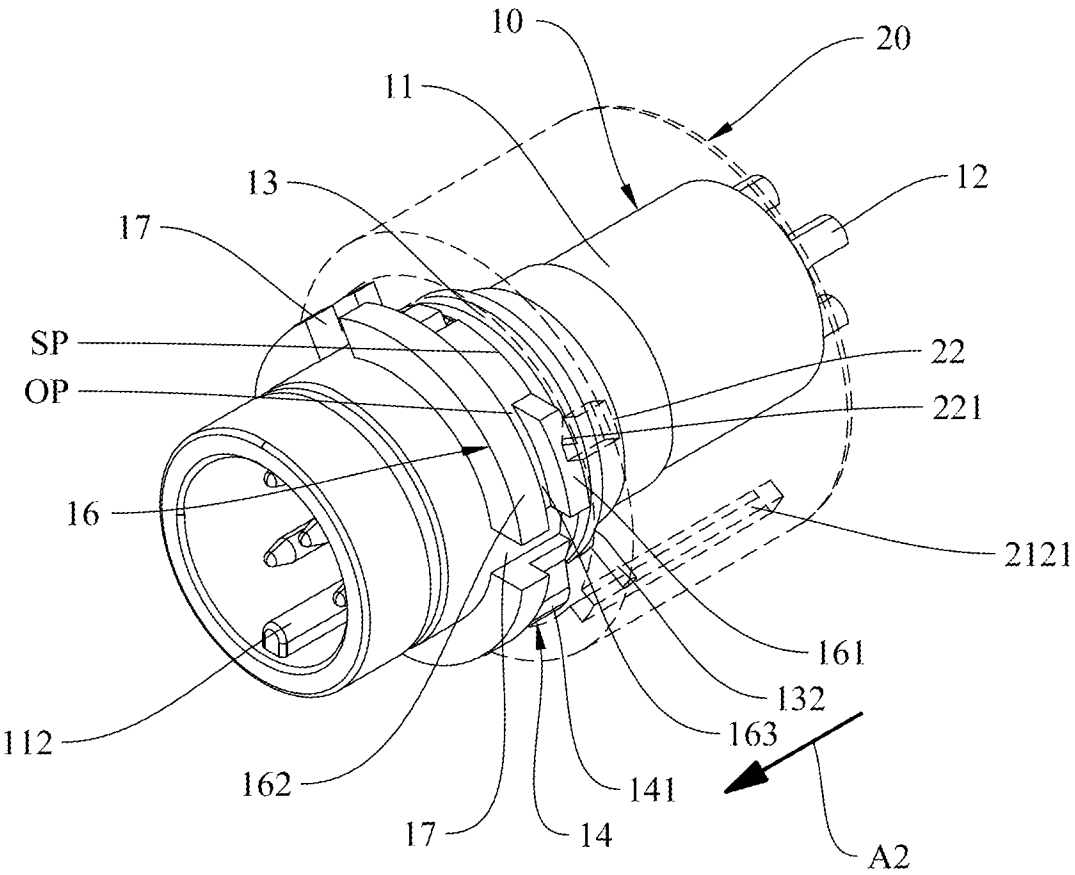
FIG. 8 is a schematic diagram (2) of the assembly process of the first embodiment of the present invention.

Next, the second end 132 of the torsion spring 13 is aligned and inserted into the opening of the guiding groove 2121 on the rotating cap 20. Then, as shown in FIG. 8, the rotating cap 20 is sleeved on the first terminal unit body 11 so that the second end 132 of the torsion spring 13 moves along the guiding groove 2121 and is pushed to the very end in the axial direction (as shown by the arrow A2) until the locking block 22 touches the first thrust wall 161.

Figure 9:
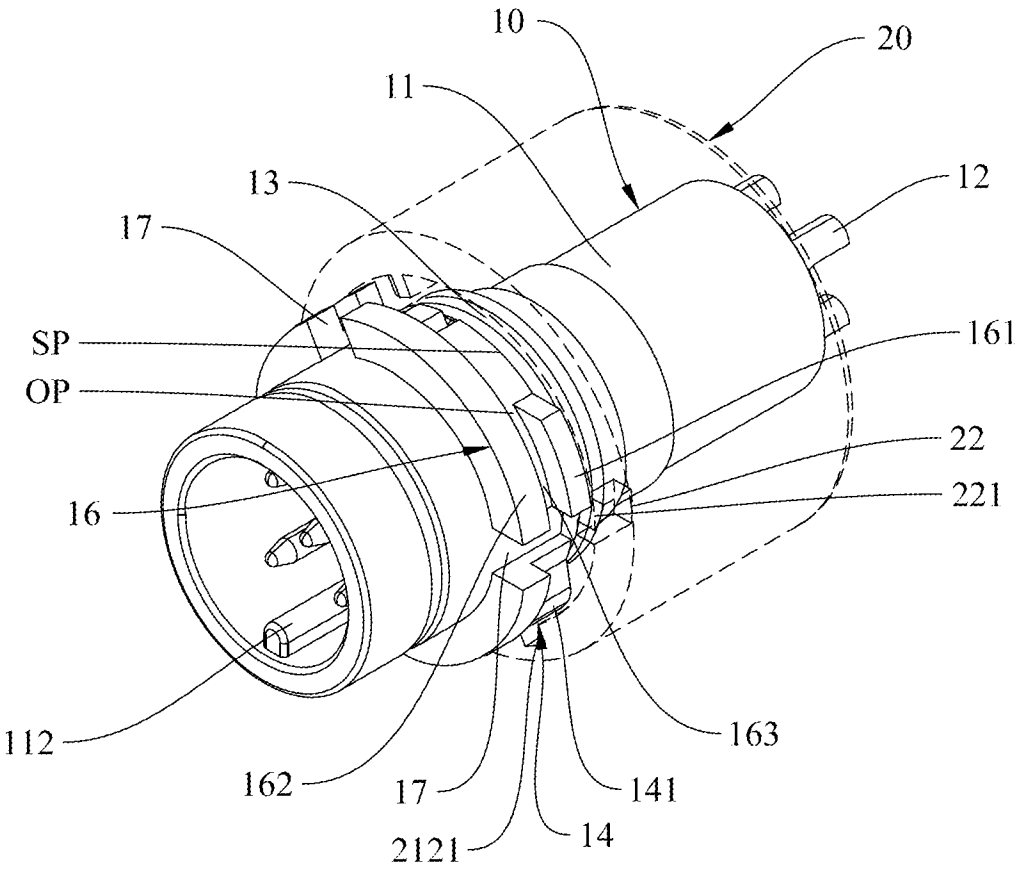
FIG. 9 is a schematic diagram (3) of the assembly process of the first embodiment of the present invention.
Figure 10:
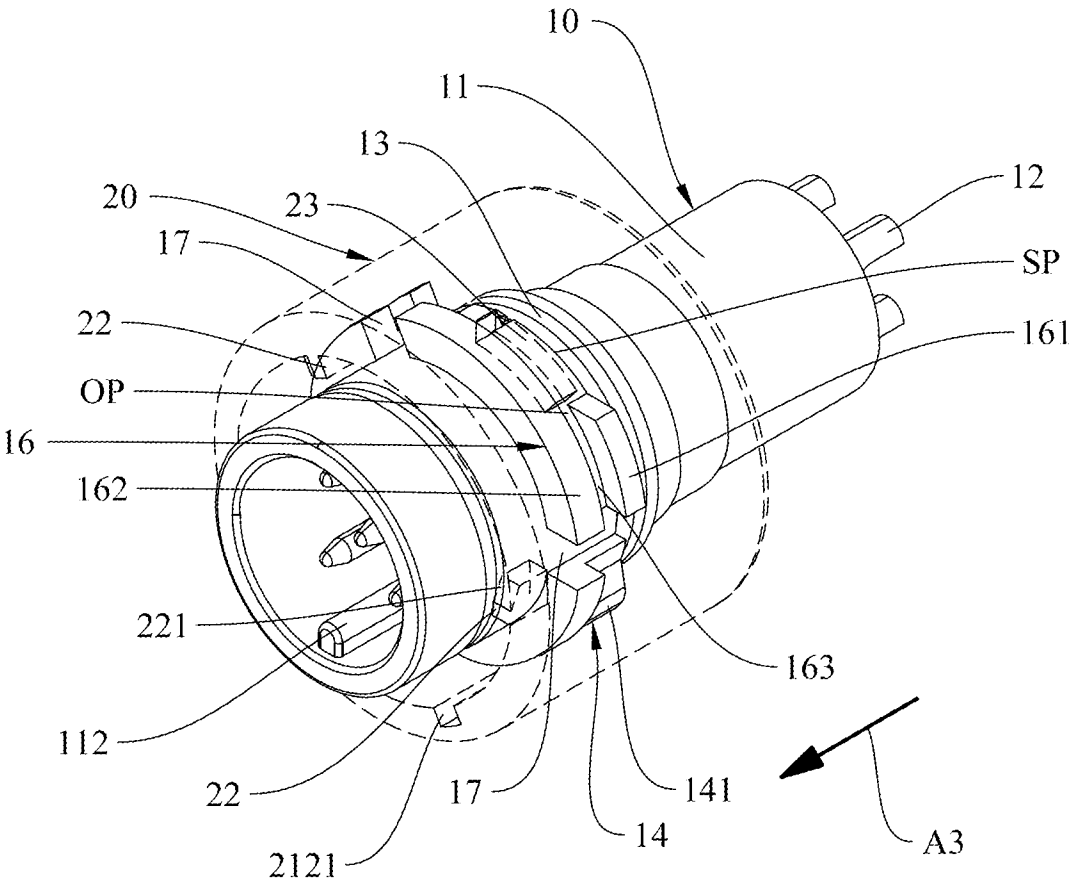
FIG. 10 is a schematic diagram (4) of the assembly process of the first embodiment of the present invention.

Next, referring to FIG. 9, the rotating cap 20 is rotated relative to the first terminal unit body 11, and the locking block 22 is aligned with a passage groove 17 passing through the adjacent lateral locking portions 16. Then, as shown in FIG. 10, the rotating cap 20 is pushed to the very end in the axial direction (as shown by the arrow A3) until the positioning wing 23 passes through the clearance space SP and touches the second thrust wall 162.

Figure 11:
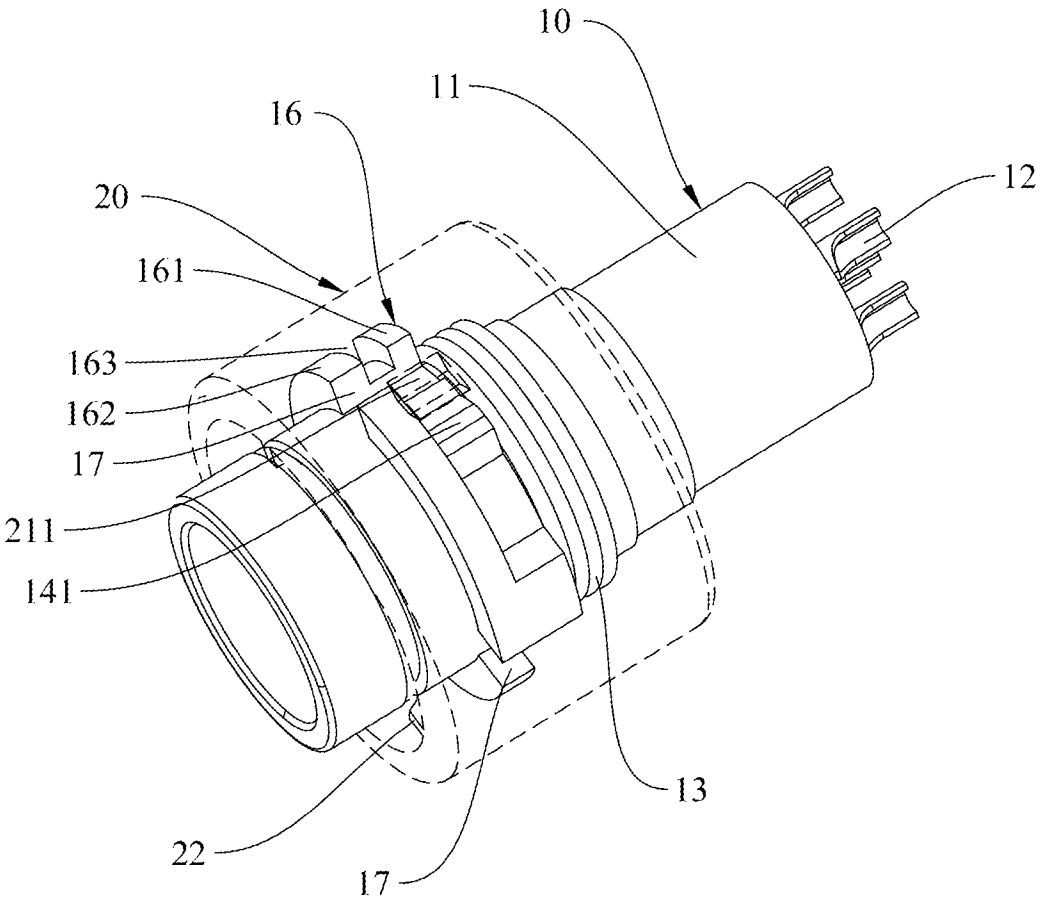
FIG. 11 is a schematic diagram (5) of the assembly process of the first embodiment of the present invention.
Figure 12:
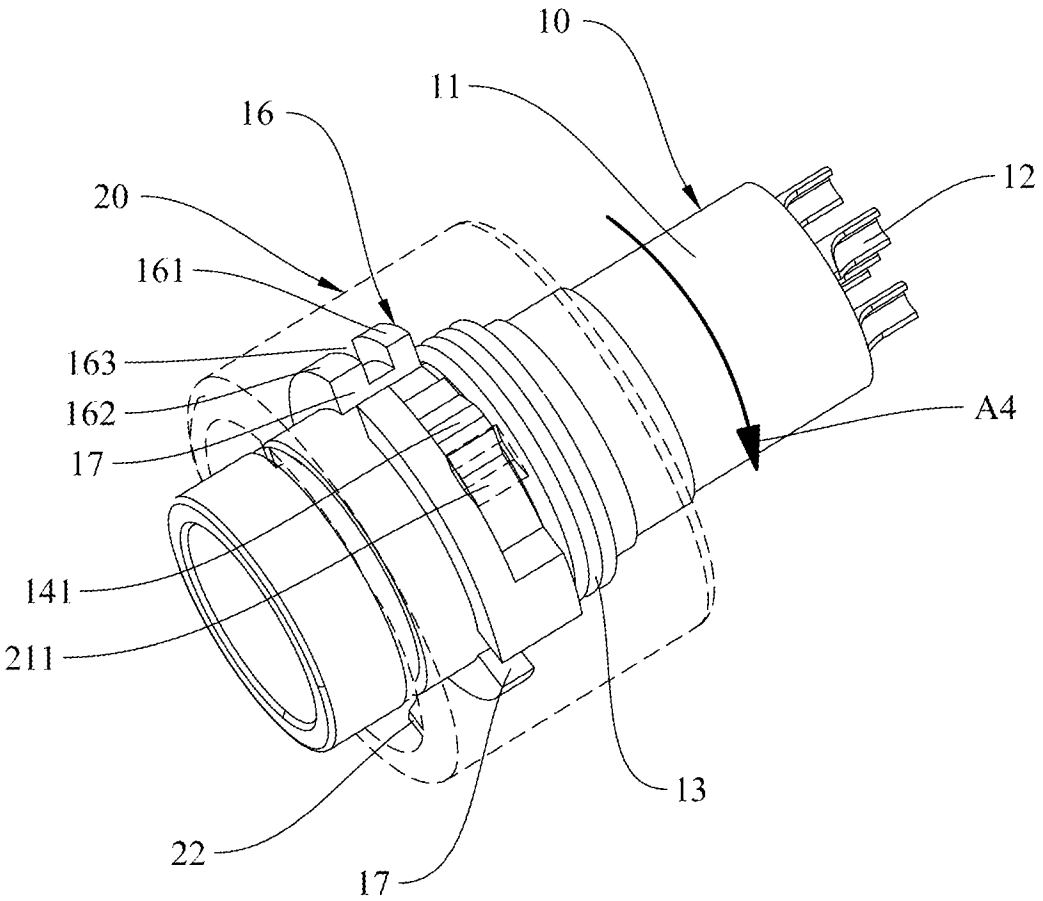
FIG. 12 is a schematic diagram (6) of the assembly process of the first embodiment of the present invention.

Next, please refer to FIG. 11. After the above assembly process, the position of the sliding block 211 is configured to coincide with the convex seat 141 on one side of the limiting groove 14. Then, as shown in FIG. 12, the rotating cap 20 is rotated to make the sliding block 211 pass through the convex seat 141 (as shown by the arrow A4) so that the sliding block 211 is moved into the limiting groove 14; at the same time, the positioning wing 23 is inserted into the fitting groove 163 between the first thrust wall 161 and the second thrust wall 162 to form an axial lock.

Figure 13:
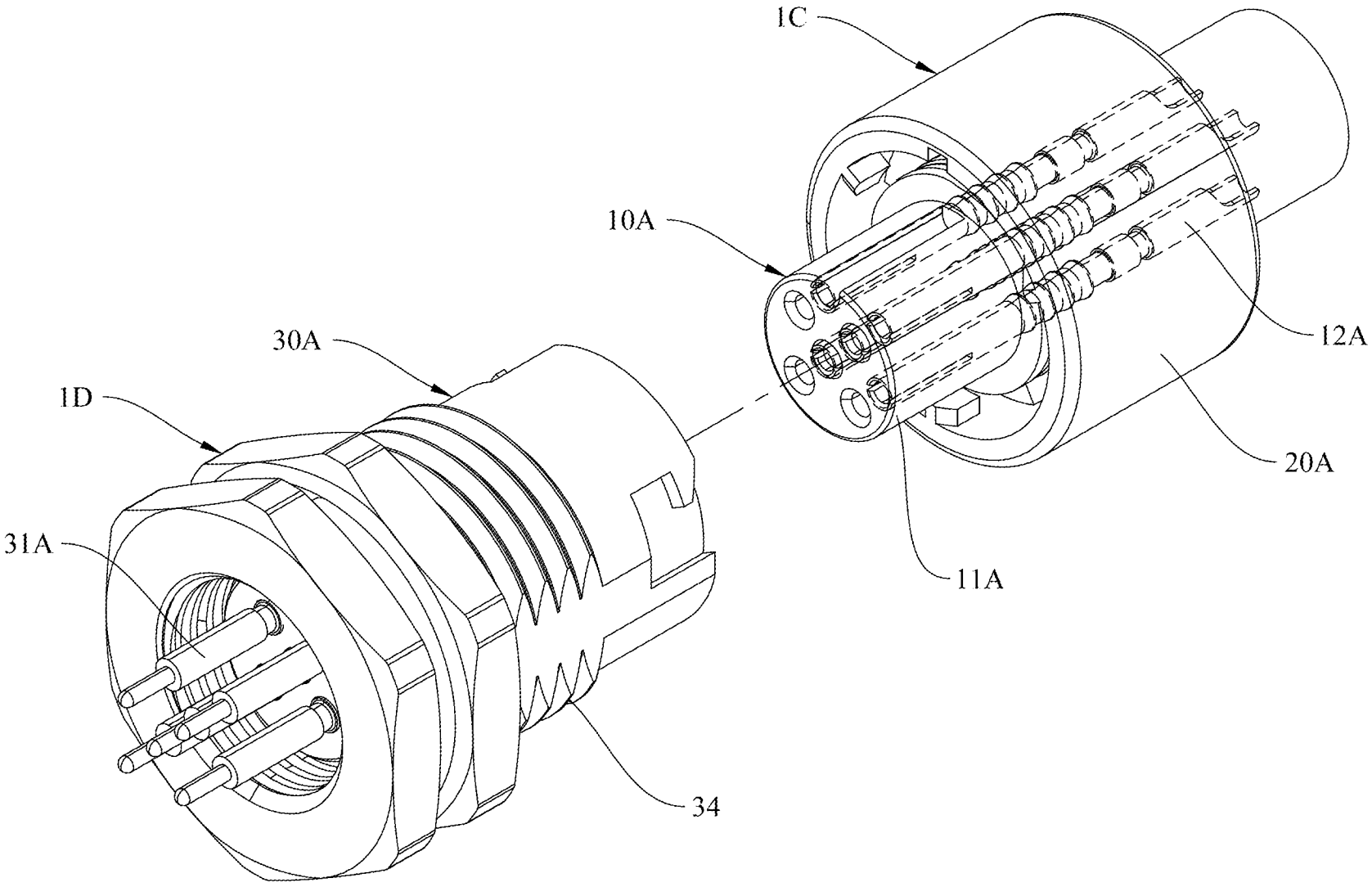
FIG. 13 is a perspective view (1) of the second embodiment of the present invention.
Figure 14:
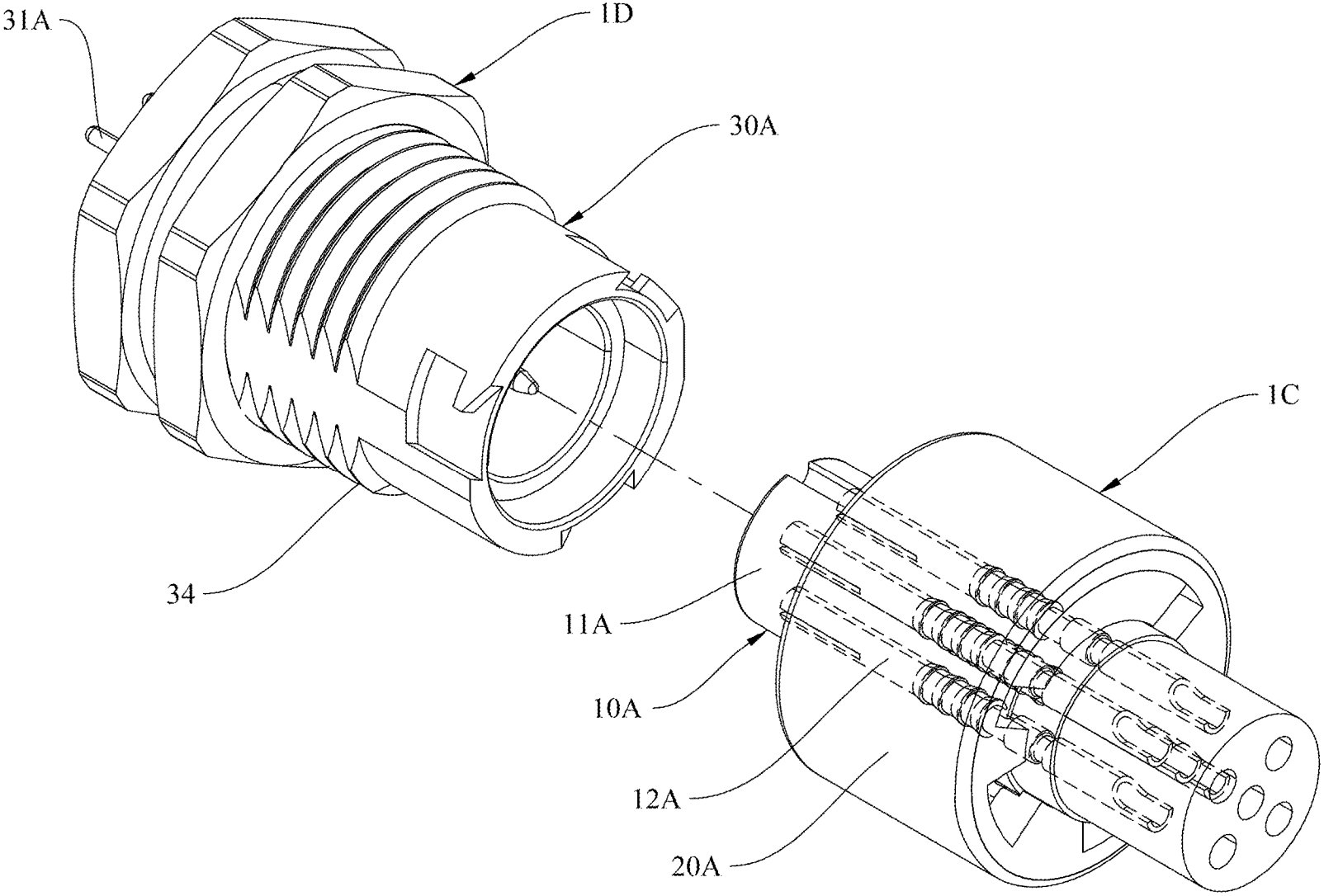
FIG. 14 is a perspective view (2) of the second embodiment of the present invention.

Except for the above-mentioned embodiments, the present invention can also be implemented with the same structure when the male and female terminals are swapped. Please refer to FIG. 13 and FIG. 14, which are schematic diagrams (1) and (2) of the appearance of the second embodiment of the invention.

In the second embodiment of the present invention, the first terminal electrical connector 1C can be implemented in the form of a male terminal, and the second terminal electrical connector 1D can be implemented in the form of a female terminal in cooperation with the first terminal electrical connector 1C. Specifically, the first terminal electrical connector 1C includes a rotating cap 20A and a first terminal unit 10A provided in conjunction with the rotating cap 20A, wherein the internal structure of the rotating cap 20A is basically the same as that of the first embodiment, and will not be repeated. Compared with the first embodiment, the electrical terminal 12A on the first terminal unit body 11A of this embodiment is implemented in the form of a terminal slot instead of a terminal pin, and is implemented in the form of a protruding post to form a male terminal; the second terminal electrical connector 1D includes a second terminal unit body 30A, wherein the outer structure of the peripheral side of the second terminal unit body 30A is basically the same as that of the first embodiment. Compared with the first embodiment, the electrical terminal 31A on the second terminal unit body 30A of this embodiment replaces the terminal slot with a terminal pin, and forms a female terminal with a slot for inserting a protruding post. The reverse arrangement of the male and female terminals, and the difference in the number, shape, and size of the terminal pins and the terminal slots are not within the scope of the invention. In another embodiment, the invention can also be used in various conventional connectors without limitation.

According to the above, the terminal electrical connector of the present invention can not only achieve the effect of quick disassembly and quick assembly, but also achieve relatively high strength in the connection in the plugging axis, and has high convenience and reliability. In addition, in terms of secondary effects, the terminal electrical connector of the invention is easier to assemble than the conventional electrical connector in the assembling process, thereby effectively improving the efficiency of the manufacturing process and reducing the cost.

The above is the detailed description of the present invention. However, the above is merely the preferred embodiment of the invention and cannot be the limitation to the implement scope of the invention, which means the variation and modification according to the invention may still fall into the scope of the invention.

What is claimed is:

1. A terminal electrical connector, including:

a terminal unit, including a terminal unit body, one or a plurality of electrical terminals provided inside the terminal unit body, and a torsion spring positioned on the terminal unit body, wherein an outer peripheral side of the terminal unit body is provided with a limiting groove for limiting a pivotal stroke and a first positioning groove for positioning a first end of the torsion spring; and a rotating cap, including a cap body, and one or a plurality of locking blocks provided on the cap body for locking on an another terminal electrical connector, wherein a sliding block and a second positioning groove are provided on an inner peripheral surface of the cap body, wherein the sliding block is correspondingly provided in the limiting groove to limit a pivotal stroke of the rotating cap relative to the terminal unit body, and a second end of the torsion spring is provided inside the second positioning groove to inertially return the rotating cap to a position of a reset angle relative to the terminal unit body.

2. The terminal electrical connector of claim 1, wherein the second positioning groove includes a guiding groove extending to an opening on one side of the rotating cap for introducing the first end of the torsion spring, and a limiting groove provided at an inner end of the guiding groove, and both sides of the limiting groove is provided with a limiting wall.

3. The terminal electrical connector of claim 2, wherein an inner peripheral surface of the rotating cap is provided with one or a plurality of positioning wings, an outer peripheral side of the terminal unit is provided with one or a plurality of lateral locking portions, the lateral locking portion includes a first thrust wall, a second thrust wall, and a fitting groove provided between the first thrust wall and the second thrust wall, and the fitting groove is configured to allow the positioning wing to be inserted when the sliding block is locked in the limiting groove to limit an axial stroke of the rotating cap relative to the terminal unit.

4. The terminal electrical connector of claim 3, wherein the first thrust wall is made shorter than the second thrust wall to form a clearance space for the positioning wing to enter the fitting groove.

5. An electrical connector assembly, including:

a terminal electrical connector of claim 1; and an another terminal electrical connector electrically connected to the terminal electrical connector, wherein the another terminal electrical connector includes an another terminal unit body and one or a plurality of electrical terminals provided inside the another terminal unit body, and the another terminal unit body has an outer peripheral surface provided with locking grooves corresponding to the number and positions of the locking blocks;

wherein the another terminal unit body of the another terminal electrical connector is butted with the terminal unit body of the terminal electrical connector to form an electrical connection, and the locking block on the rotating cap is inserted into and locked to the locking groove via an inertial force of the torsion spring to limit an axial stroke between the terminal electrical connector and the another terminal electrical connector.

6. The electrical connector assembly of claim 5, wherein the locking groove includes an opening provided on the outer peripheral surface and a groove provided on the outer peripheral surface and communicating with the opening.

7. The electrical connector assembly of claim 6, wherein the terminal unit body of the terminal electrical connector is provided with a first limiting portion, the another terminal unit body of the terminal electrical connector is provided with a second limiting portion corresponding to the position of the first limiting portion, and the inertial force of the torsion spring provides a torsion force from the opening toward the groove to rotate the rotating cap to lock the locking block on an inner side of the groove.

8. The electrical connector assembly of claim 7, wherein the locking block is provided with a first guiding slope, and the locking groove is provided with a second guiding slope on one side of the opening.

9. The electrical connector assembly of claim 5, wherein the outer peripheral surface of the another terminal unit body is provided with a screw thread.

* * * * *